US006186366B1

(12) United States Patent
Good et al.

(10) Patent No.: US 6,186,366 B1
(45) Date of Patent: Feb. 13, 2001

(54) FLUID DISPENSER WITH CHILD-RESISTANT NOZZLE ASSEMBLY

(75) Inventors: Robert J. Good, Raytown; Phillip J. Dimaggio, Kansas City, both of MO (US)

(73) Assignee: Calmar Inc., City of Industry, CA (US)

( * ) Notice: Under 35 U.S.C. 154(b), the term of this patent shall be extended for 0 days.

(21) Appl. No.: 09/309,582

(22) Filed: May 11, 1999

(51) Int. Cl.[7] ..... B67B 5/00
(52) U.S. Cl. ..... 222/153.14; 222/383.1
(58) Field of Search ..... 222/153.14, 383.1, 222/153.07, 380; 239/333

(56) References Cited

U.S. PATENT DOCUMENTS

| | | | | |
|---|---|---|---|---|
| 4,204,614 | * | 5/1980 | Reeve | 222/153 |
| 4,516,695 | | 5/1985 | Garneau . | |
| 4,706,888 | | 11/1987 | Dobbs . | |
| 5,050,779 | * | 9/1991 | Knickerbocker | 222/153 |
| 5,088,628 | * | 2/1992 | Knickerbocker | 222/153 |
| 5,222,637 | * | 6/1993 | Giuffredi | 222/336 |
| 5,535,952 | * | 7/1996 | Tada | 239/333 |
| 5,662,246 | | 9/1997 | Contaxis, III . | |
| 5,687,880 | | 11/1997 | Maas et al. . | |
| 5,848,733 | * | 12/1998 | Foster et al. | 222/153.13 |

* cited by examiner

*Primary Examiner*—Joseph A. Kaufman
*Assistant Examiner*—Melvin A. Cartagena
(74) *Attorney, Agent, or Firm*—Dykema Gossett PLLC

(57) ABSTRACT

The nozzle cap of the dispenser is rotatably supported at the nozzle end of the dispenser body for rotation between ON and OFF positions. At least one locking member is integrally connected to the body to form a flexible connector which permits rocking movement of the locking member. The locking member extends laterally from one side of the body so as to be in full view when the dispenser is held in the hand of a user. The locking member fits within a recess formed in the nozzle cap to lock the nozzle cap against rotation when the nozzle cap is in OFF position. Inward pressure on the locking member releases it from the recess to permit rotation of the nozzle cap to ON position. The nozzle cap includes a discharge passage in communication with a discharge opening and may also include one or more additional passages which provide communication between a portion of the nozzle cap near the discharge opening and ambient air to prevent a child from sucking contents of the container through the discharge opening.

22 Claims, 2 Drawing Sheets

FLUID DISPENSER WITH CHILD-RESISTANT NOZZLE ASSEMBLY

BACKGROUND OF THE INVENTION

The present invention relates to a fluid dispenser with a child-resistant nozzle assembly, and more particularly to a fluid dispenser having a dispenser body which rotatably supports a nozzle cap rotatable relative to the body into various ON positions such as a spray position, a stream position and an OFF position. The child-resistant nozzle assembly is designed to prevent children from using the dispenser in an unintended manner.

Such dispensers present certain problems when children have access thereto. One such problem arises when children attempt to turn the nozzle cap from the OFF position to one of the other operative ON positions of the nozzle cap. It is therefore desirable to provide an arrangement wherein the nozzle cap can be locked against rotation relative to the dispenser body when in the OFF position, and further wherein the locking action will occur automatically when the nozzle cap is turned to such position. Additionally, unlocking of the nozzle cap should be easy for an adult to accomplish, yet very difficult if not virtually impossible for a child.

In order to prevent children from rotating such nozzle caps, various prior art constructions have been designed which require that two different manual functions must be carried out simultaneously in order to release the rotatable nozzle cap so that it can be moved into one of its ON operative modes. For example, various locking arrangements have been developed wherein a locking member supported by the dispenser body engages a cooperating locking member on the nozzle cap. With this type of device, it is necessary to move the locking member with one hand while rotating the nozzle with the other hand, which is a very difficult operation for a child to carry out.

U.S. Pat. No. 4,516,695 discloses a construction wherein a locking member automatically moves into locking position when the nozzle cap is rotated into an OFF position. A flex arm member extends downwardly beneath the lower or underside of the nozzle cap and nozzle end of the dispenser body. The flex arm is adapted to be pulled rearwardly of the device by the trigger finger of a user to move the locking member into a release position when the device is held in its normal position within the user's hand. The nozzle cap can then be rotated into the desired position. The disadvantage of such structure is that the flex arm cannot be readily seen by the user, and access to the flex arm is not convenient. Therefore, this prior art device is difficult even for an adult to use. Furthermore, the flex arm can be easily moved rearwardly by the tip of a finger from a point in front of the nozzle cap so that accidental release of the locking mechanism is possible.

A further problem encountered with nozzle caps of the type discussed above is that children have a tendency to suck on the outer end of the nozzle. This may result in some of the fluid in the dispenser entering into the child's mouth. This can be a dangerous situation since many of the fluids contained in such dispensers could if ingested make a child ill. It is noted that even if the nozzle is in OFF position and the dispenser has been previously used, there may be some residual dispenser fluid in the dispenser downstream of its shut-off valve. It is therefore an object of the invention to provide means for preventing children from sucking any significant amount of dispenser fluid from the discharge opening of the nozzle cap.

SUMMARY OF THE INVENTION

The present invention provides an improved dispenser wherein at least one locking member is movably supported by the dispenser body and extends laterally from one side portion of the body so as to be in full view when the dispenser is held in the hand of a user. The locking member engages a flat surface or recess in the nozzle cap to positively lock the nozzle cap against rotation relative to the dispenser body. The locking member is integral with the body to form a flexible connector hinge which permits rocking movement of the locking member relative to the body and further ensures that the locking member will automatically move into its locking position when the nozzle is rotated to its OFF position.

The "dispenser body" as described and claimed refers to the pump body with or without an outer shroud connected thereto. And the locking member(s) may be integrally connected with the pump body or with the shroud, in accordance with the invention. In one embodiment the locking member is integrally connected with the pump body. When a shroud is employed as illustrated, the shroud is provided with slot means therein adjacent the nozzle end of the body for receiving a portion of the locking member and allowing it to rock back and forth between its locking and unlocked positions. Otherwise, when a shroud is employed, the locking member may be integrally connected with the shroud in accordance with another embodiment.

The dispenser may also have a pair of locking members mounted at opposite sides of the dispenser to provide a more positive locking action. These opposing locking members may be simultaneously moved into release or unlocking position by squeezing the two locking members between two fingers of the user's hand.

In order to prevent sucking of dispenser fluid from the nozzle cap, the nozzle cap may be provided with passage means in addition to the discharge passage means formed therein. This additional passage means may take the form of a plurality of passages or may be a single passage, as so desired. The additional passage means, which provides communication between a portion of the nozzle cap near the discharge opening thereof and ambient air, may be located within the confines of the outer periphery of the nozzle cap or may be located externally so as to lie on an outer wall of the cap. With such a construction, when a child sucks on the nozzle cap, ambient air is drawn into the child's mouth in such quantity that there is not sufficient suction applied to the discharge opening of the nozzle cap to draw any significant amount of fluid through the discharge opening. Thus, a child is prevented from aspirating undesirable fluid from the dispenser into the mouth in a simple yet highly effective manner.

The locking member arrangement for preventing the nozzle cap from rotating from its OFF position and the additional passage means provided in the nozzle cap for preventing undesired sucking of fluid from the dispenser form two different features which can be employed individually in nozzle caps, or the two features may be employed in the same nozzle cap to provide both forms of child resistance.

DESCRIPTION OF THE PREFERRED EMBODIMENTS

Figure 1:
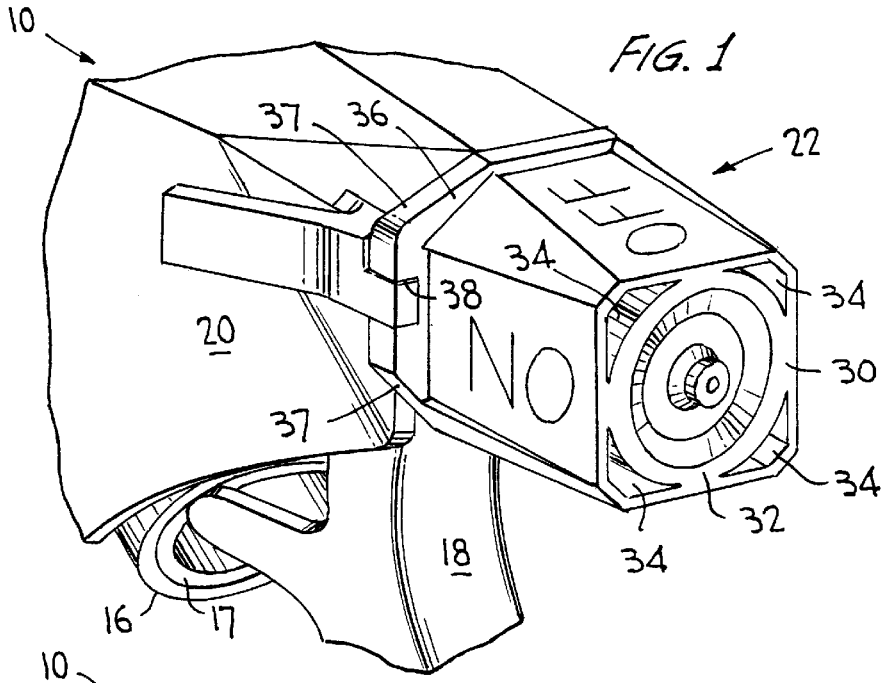
FIG. 1 is a top perspective view of a first form of the invention shown in one operative position.
Figure 2:
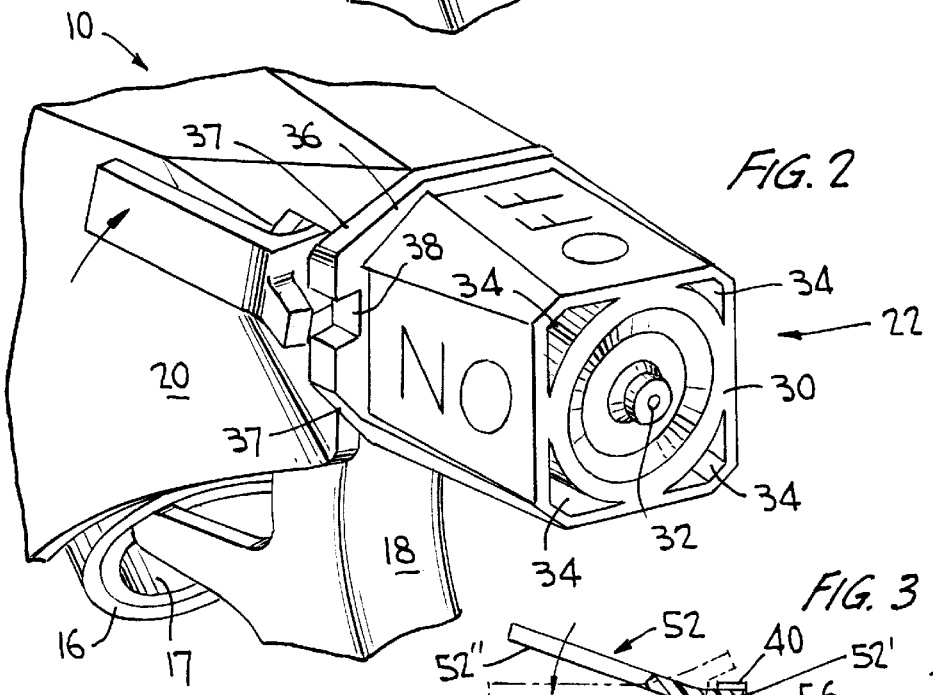
FIG. 2 is a view similar to FIG. 1 showing a second operative position.
Figure 3:
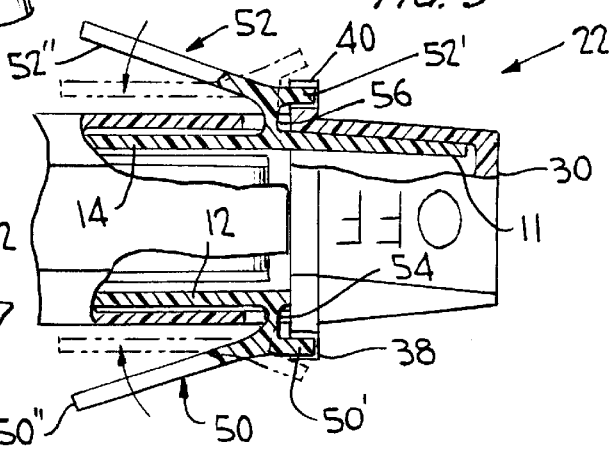
FIG. 3 is a top view, partly broken away, of the device shown in FIG. 1.

Referring now to the drawings, a first form of the invention is shown in FIGS. 1–3. Part of a fluid dispenser 10 is shown in FIGS. 1 and 2 in the form of a manually operated trigger dispenser including a conventional pump body having a nozzle end 11 as seen in FIG. 3, and a pair of side portions 12 and 14 which are joined by a top portion (not shown). The pump body has a pump cylinder 16 containing a reciprocable pump piston 17 which is manually reciprocated in known manner by a trigger actuator 18 hingedly mounted on the pump body. A conventional shroud 20 may be supported in overlying relationship and connected to the pump body in some normal manner, although the invention can also be utilized with a dispenser which does not have a shroud.

Figure 7:
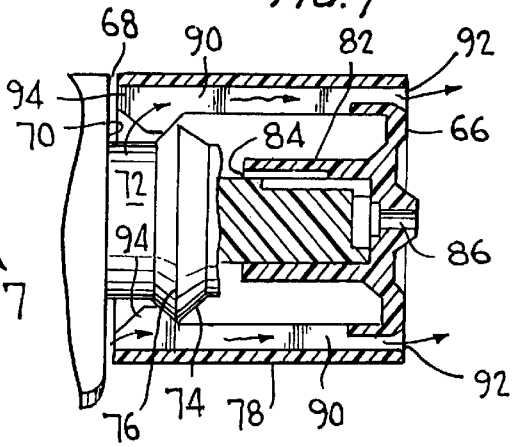
FIG. 7 is a sectional view, partly broken away, of the nozzle cap, taken on line 7—7 of FIG. 6, and illustrating the nozzle cap mounted on the associated pump body.
Figure 6:
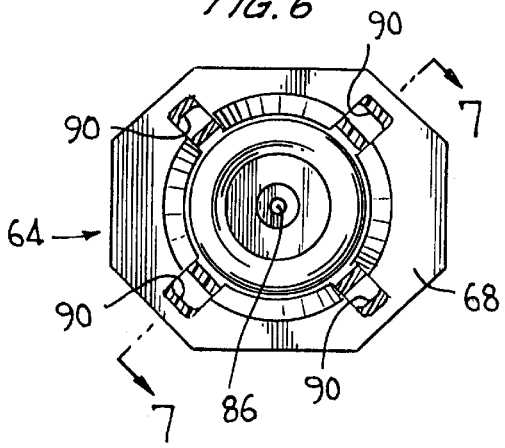
FIG. 6 is a view of the rear face of the nozzle cap shown in FIG. 4.

A nozzle cap 22 is rotatably supported at the nozzle end 11 of the pump body. The nozzle cap may have a rectangular external configuration as seen in FIGS. 1 and 2 to facilitate manual rotation of the cap. The cap has markings on two sides thereof such as OFF on a pair of opposed walls. The other two opposed walls are illustrated as having ON markings for the purpose of describing the invention, but in actuality will have markings thereon such as "STREAM " and "SPRAY". The internal mechanism of the nozzle cap and the manner in which the nozzle is mounted on the pump body may be similar to that shown in U.S. Pat. No. 4,706,888, the disclosure of which is incorporated by reference. The internal details of the nozzle cap 22 as well as the manner in which the nozzle cap is rotatably mounted are shown in FIG. 7 where a similar nozzle cap is illustrated.

The nozzle cap includes a front face 30 having a discharge opening 32 located at the center as in the normal manner. Four passages 34 are respectively formed at the four corners of the front face for a purpose which will be described hereinafter. The nozzle cap has a laterally extending peripheral flange 36 formed at the end of the nozzle cap adjacent the nozzle end of the pump body. The flange is provided with a pair of notches 38 and 40 as seen in FIG. 3, only notch 38 being visible in FIGS. 1 and 2.

As seen in FIG. 3, a pair of locking members 50 and 52 are molded integral with the pump body side portions 12 and 14 to form flexible connectors 54 and 56 respectively which permit rocking movement of the two locking members relative to the pump body. The flexible connectors are formed at intermediate points along the locking members 50 and 52 to define first ends 50' and 52' respectively which are received with the recesses in the flange on the nozzle cap and second ends 50" and 52" respectively which extend rearwardly of the nozzle end of the pump body so that they can be manually engaged to release the locking members from the notches.

The pump body is formed of plastic material, and the flexible connectors provide resilient connections between the pump body and the locking members which normally bias the locking members into the locking position shown in FIGS. 1 and 3. The locking ends 50' and 52' snugly fit within the notches 38 and 40 with the flat sides thereof facing one another so as to provide a positive locking action preventing rotation of the nozzle cap with respect to the pump body. The locking members are in full view when the dispenser is held in the hand of a user and are readily accessible when the locking members are in the position shown in FIGS. 1 and 3.

Figure 3A:
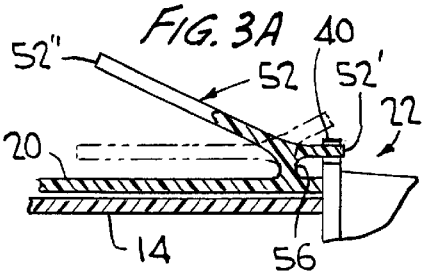
FIG. 3A is a view similar to FIG. 3 showing the locking member alternatively on the pump shroud.
Figure 4:
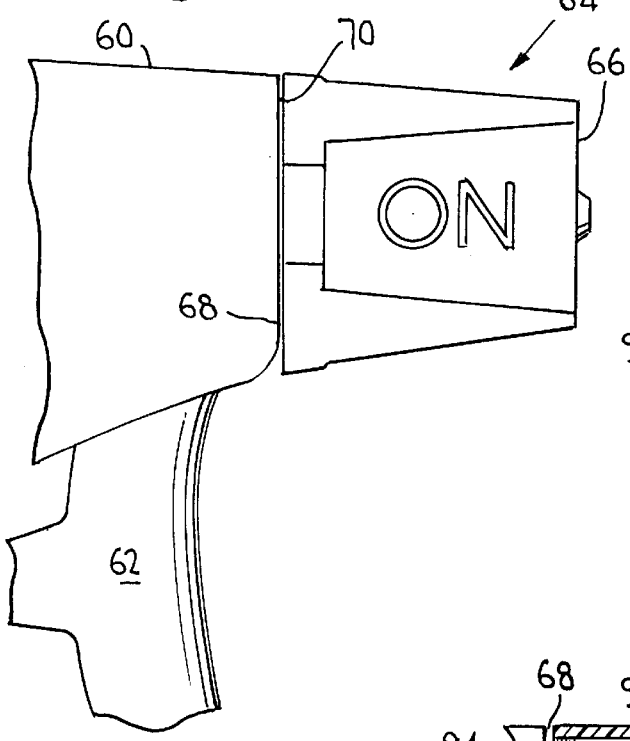
FIG. 4 is a side view of another form of the invention.

As shown in FIG. 3A, the locking members (only one shown) may alternatively be integrally molded with side portions of shroud 20 which overlies the pump body which is connected thereto in a manner known in the art.

When it is desired to unlock the nozzle cap for rotary movement, the ends 50" and 52" of the locking members can be squeezed between two fingers to move the opposite ends 50' and 52' of the locking members out of the notches, whereupon the nozzle cap can be rotated to an ON position where the ON marking faces upwardly. When the nozzle cap is again rotated to a position where one of its OFF positions is facing upwardly, the locking members will be automatically moved back into the position shown in FIGS. 1 and 3. Such may be provided as by chamfers 37 leading into notches 38 and 40, as shown in FIGS. 1 and 2.

Although the invention has been described with reference to an opposing pair of locking members 50, 52 having ends 50', 52' respectively in engagement with notches 38, 40, only one of such locking members, or its equivalent with its first end engageable with a confronting notch need be provided without departing from the invention.

Referring now to FIGS. 4–7 inclusive, another form of the invention is illustrated. A dispenser 60 is provided with a trigger actuator 62 which operates in the usual manner. A nozzle cap 64 has a front face 66 and a rear face 68 which is slightly spaced from the nozzle end face 70 of the pump body. The nozzle cap is rotatably supported on a tubular outlet member 72 of the dispenser by a snap fit produced between an external rib 74 formed on member 72 and an internal rib 76 formed within cap skirt 78.

Figure 5:
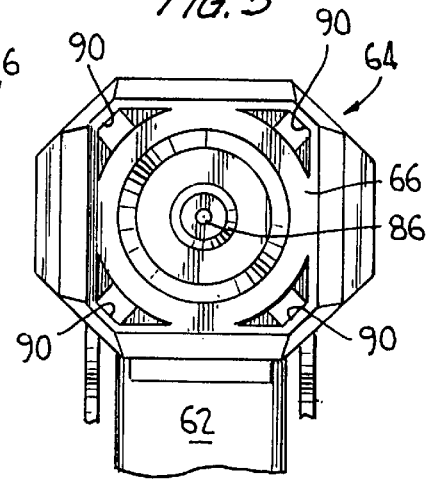
FIG. 5 is a front view of a portion of the device shown in FIG. 4.

An integral cylindrical sleeve 82 formed on the nozzle cap has discharge passage means formed therein in the form of three equally spaced passages 84 which are in communication with a discharge opening 86 formed at the center of front face 66. Additional passage means is provided within the nozzle cap for providing communication between a portion of the nozzle cap near the discharge opening and ambient air. One or more passages may be provided, and as illustrated in FIG. 5, four passages 90 are provided. These passages correspond to the passages 34 described in connection with FIGS. 1 and 2 of the drawings. As seen in FIG. 7, one end 92 of each passage opens at front face 76 at a position which is near the discharge opening 86, and the other end 94 of each passage is in communication with the rear face 68 of the nozzle cap. It is noted that since the rear face of the nozzle cap is spaced from the outer end face of the pump body, air can freely flow between these faces and thence forwardly through passages 90 to the front face of the nozzle cap.

If a child attempts to suck on the nozzle cap as shown on FIG. 7, the child's mouth will surround the nozzle cap so that when suction is applied to the nozzle cap, air will be drawn through the additional passage means 90, thereby preventing any significant amount of fluid from being drawn into the mouth of the child through the discharge opening 86.

Figure 8:
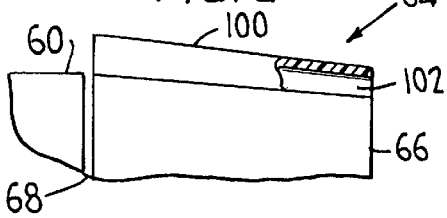
FIG. 8 is a view similar to FIG. 4 of another embodiment.
Figure 9:
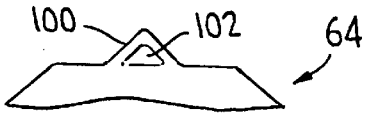
FIG. 9 is a front view of the device of FIG. 8.

The air passage or passages 90 may be formed within the outer periphery of the nozzle cap as described with reference to FIGS. 4 to 7, or may be formed externally of the nozzle cap periphery as shown in FIGS. 8 and 9. For example, a conduit 100 is provided on one or more of the outer faces of cap 64, the conduit extending between front and rear faces 66, 68, and defining an air passage 102 extending between faces 66, 68. Although the conduit 100 is shown in triangular in FIGS. 8 and 9, it can be of any alternate shape such a rectangular, circular, oval etc., without departing from the invention.

Air passage or passages 102 function in the same manner as described with reference to FIGS. 4 to 7.

The dispenser shown in FIGS. 1–3 may be employed without passages 34 to provide only the single child-resistant feature of means for locking the nozzle cap against rotation with respect to the pump body. Alternatively, the dispenser shown in FIGS. 1–3 can also employ the passages 34 which are similar to passages 90 as discussed in connection with FIGS. 4–7 in which case passages 34 open through the rear face of nozzle cap 22 to provide communication between the ends of passages 34 at the front face 30 of the nozzle cap and ambient air. When the additional passage means is employed with the construction shown in FIGS. 1 and 2, the rear face of the nozzle cap will be spaced from the outer end face of the pump body. In this manner, the device shown in FIGS. 1–3 may incorporate two child-resistant features into one structure.

It is also evident that the embodiments shown in FIGS. 4–7 and 8 and 9 can be utilized with the single child resistant feature of preventing a child from sucking fluid from the dispenser when sucking on the nozzle cap.

Obviously, many other modifications and variations of the present invention are made possible in the light of the above teachings. It is therefore to be understood that within the scope of the appended claims the invention may be practiced otherwise than as specifically described.

What is claimed is:

1. A fluid dispenser comprising in combination, a dispenser body having a pair of opposing side portions, a nozzle end, a nozzle cap rotatably supported at the nozzle end for rotation between ON and OFF positions of said nozzle cap, a child-resistant nozzle assembly comprising said nozzle cap having a recess formed therein, a movable lock member integrally connected with said dispenser body to form a flexible connector and extending laterally from one of the side portions of said body so as to be in full view when the dispenser is held in the hand of a user, said flexible connector being formed at an intermediate portion of the locking member between said opposite ends thereof, one of said ends being disposed within said recess to lock the cap against rotation from an OFF position and the other of said ends extending outwardly of said one side portion and rearwardly of the nozzle end of said body so that manual pressure applied to said other end moves said one end out of said recess to unlock the nozzle.

2. A dispenser according to claim 1, wherein said dispenser body comprises a pump body.

3. A dispenser according to claim 1, wherein said dispenser body comprises a pump body having an outer shroud connected thereto.

4. A dispenser as defined in claim 3, wherein said shroud has slot means receiving a portion of the locking member.

5. A dispenser as defined in claim 1 wherein said recess is a notch and said locking member includes a portion snugly received in said notch when the cap is in the OFF position.

6. A dispenser as defined in claim 5, wherein said cap has a laterally extending flange adjacent said nozzle end of the body, said notch being formed in said flange.

7. A fluid dispenser comprising in combination, a dispenser body having a pair of opposing side portions, a nozzle end, a nozzle cap rotatably supported at the nozzle end of for rotation between ON and OFF positions of said nozzle cap, a child-resistant nozzle assembly comprising said nozzle cap having first and second recesses formed therein, first and second locking members movably supported by said dispenser body and extending laterally from the opposing side portions of said body so as to be in full view when the dispenser is held in the hand of a user, said locking members engaging said recesses to lock the nozzle cap against rotation relative to said body when the nozzle cap is in the OFF position.

8. A dispenser as defined in claim 7, wherein each of said first and second locking members is integrally connected with said dispenser body to form said flexible connector which permits rocking movement of each locking member relative to said dispenser body.

9. A dispenser as defined in claim 7, wherein said dispenser body comprises a pump body having an outer shroud connected thereto, first slot means formed in said shroud and receiving a portion of said first-mentioned locking member, and second slot means formed in said shroud and receiving a portion of said second locking member.

10. A fluid dispenser comprising, a dispenser body having a nozzle end, a child-resistant nozzle assembly comprising a nozzle cap rotatably supported at the nozzle end of said body for rotation between ON and OFF positions of said nozzle cap, said nozzle cap having discharge passage means formed therein in communication with a discharge opening for discharging fluid from the nozzle cap, said nozzle cap having additional passage means for comprising a plurality of separate passages formed in said nozzle cap providing communication between a portion of said nozzle cap adjacent said discharge opening and ambient air.

11. A dispenser as defined in claim 10, wherein said nozzle cap has a front face and a rear face, said additional passage means opening at said front face adjacent said discharge opening and extending to said rear face so that ambient air can flow from said rear face to said front face.

12. A dispenser as defined in claim 11, wherein said additional passage means is confined within an outer periphery of said nozzle cap.

13. A dispenser as defined in claim 10, wherein said additional passage means is formed on an outer periphery of said nozzle cap.

14. A dispenser as defined in claim 10, wherein said nozzle cap has a front face and a rear face, each of said passages having one end thereof opening at said front face, and the opposite end of each of said passages extending to said rear face.

15. A fluid dispenser comprising in combination, a dispenser body having a pair of opposite side portions, a nozzle end, a nozzle cap rotatably supported at the nozzle end of said body for rotation between ON and OFF positions of said nozzle cap, a child-resistant nozzle assembly comprising said nozzle cap having a recess formed therein, a locking member movably supported by said dispenser body and extending laterally from one side portion of said body so as to be in full view when the dispenser is held in the hand of a user, said locking member engaging said recess to lock the nozzle cap against rotation relative to said body when the nozzle cap is in the OFF position, said nozzle cap having discharge passage means formed therein being in communication with a discharge opening for discharging fluid from the nozzle cap, said nozzle cap having additional passage means comprising a plurality of separate passages formed in said nozzle cap for providing communication between a portion of said nozzle cap adjacent said discharge opening and ambient air.

16. A dispenser as defined in claim 15, wherein said nozzle cap has a front face and a rear face, said discharge opening being disposed at said front face, said additional passage means opening at said front face adjacent said discharge opening and being in communication with said rear face so that ambient air can flow from said rear face to said front face.

17. A dispenser as defined in claim 16, wherein said additional passage means is confined within an outer periphery of said nozzle cap.

18. A dispenser as defined in claim 15, wherein said additional passage means is formed on an outer periphery of said nozzle cap.

19. A dispenser as defined in claim 15, wherein said nozzle cap has a front face and a rear face, each of said passages having one end thereof opening at said front face, and the opposite end of each of said passages being in communication with said rear face.

20. A fluid dispenser comprising in combination, a dispenser body having a pair of opposite side portions, a nozzle end, a nozzle cap rotatably supported at the nozzle end of said body for rotation between ON and OFF positions of said nozzle cap, a child-resistant nozzle assembly comprising said nozzle cap having first and second recesses formed therein, first and second locking members movably supported by said dispenser body and extending laterally from the opposite side portions of said body so as to be in full view when the dispenser is held in the hand of a user, said locking member engaging said recesses to lock the nozzle cap against rotation relative to said body when the nozzle cap is in the OFF position, said nozzle cap having discharge passage means formed therein being in communication with a discharge opening for discharging fluid from the nozzle cap, said nozzle cap having additional passage means for providing communication between a portion of said nozzle cap adjacent said discharge opening and ambient air.

21. A dispenser as defined in claim 20, wherein each of said first and second locking members is integrally connected to said body to form a flexible connector which permits rocking movement of each locking member relative to said body.

22. A dispenser as defined in claim 20, wherein said dispenser body comprises a pump body having an outer shroud connected thereto, first slot means formed in said shroud at and receiving a portion of said first-mentioned locking member, and second slot means formed in said shroud and receiving a portion of said second locking member.

* * * * *